US005087351A

United States Patent [19]

Valentine, Sr.

[11] Patent Number: 5,087,351

[45] Date of Patent: Feb. 11, 1992

[54] FLUIDIZED BED PEANUT SORTER

[75] Inventor: Howard E. Valentine, Sr., Ozark, Ala.

[73] Assignee: Golden Peanut Company, a Georgia General Partnership, Atlanta, Ga.

[21] Appl. No.: 561,566

[22] Filed: Aug. 2, 1990

[51] Int. Cl.[5] ..... B03B 4/00; B07B 4/08

[52] U.S. Cl. ..... 209/20; 209/467; 209/474; 209/488; 209/490

[58] Field of Search ..... 209/20, 44.2, 466, 467, 209/468, 469, 474, 475, 476, 486, 488, 490, 492, 502, 504, 506, 508

[56] References Cited

U.S. PATENT DOCUMENTS

| | | | |
|---|---|---|---|
| 750,367 | 1/1904 | Jahraus | 209/476 |
| 1,786,739 | 12/1930 | Davis | 209/467 |
| 2,404,414 | 7/1946 | Sutton | 209/467 |
| 2,427,423 | 9/1947 | Shawcross | 209/467 |
| 2,429,343 | 10/1947 | Carter et al. | 209/21 |
| 2,449,007 | 9/1948 | Paul | 209/19 |
| 2,928,545 | 3/1960 | Forsberg | 209/20 X |
| 3,007,577 | 11/1961 | Putman | 209/474 X |
| 3,400,814 | 9/1968 | Hobbs | 209/20 |
| 3,464,553 | 9/1969 | Hancock | 209/467 |
| 3,734,289 | 5/1973 | Pearman | 209/490 X |
| 4,793,918 | 12/1988 | Thomas | 209/467 |

FOREIGN PATENT DOCUMENTS

| | | | |
|---|---|---|---|
| 2258904 | 8/1975 | France | 209/474 |
| 2059810 | 4/1981 | United Kingdom | 209/466 |

*Primary Examiner*—Michael S. Huppert
*Assistant Examiner*—Edward M. Wzcyra
*Attorney, Agent, or Firm*—Foley & Lardner

[57] ABSTRACT

A modified fluidized bed separates materials differing in weight by as little as one percent. A fluidized bed is formed by directing air through vanes on an underside of a screen. Products, such as peanuts, delivered to a central portion of the screen are initially separated so that lighter weight products float on the fluidized bed and are drawn by gravity toward a lower end where a second separation takes place. The lightest products at this second end are listed over an exit weir by a controllable air jet. Desired products are not ejected and are collected.

14 Claims, 3 Drawing Sheets

FLUIDIZED BED PEANUT SORTER

BACKGROUND OF THE INVENTION

1. Field of the Invention

The present invention relates to a peanut processing apparatus, and more particularly, to an apparatus and method for separating peanuts, which have an undesirable aflatoxin content and other light undrainable apparatus, by means of a fluidized bed.

2. Discussion of the Related Art

Aflatoxin is a carcinogen produced by a fungus which is commonly found in peanuts. Although not always visible from the outside, Aflatoxin affects the density of the peanut. A peanut afflicted with aflatoxin may also develop a hollow center.

Conventional separation techniques have proven unsatisfactory for separating the affected peanuts. These techniques are not sufficiently sophisticated to allow separation of peanuts having density differences as low as 10 percent. Nevertheless, as stricter aflatoxin regulations are implemented, it has become necessary to develop an apparatus and method which is capable of making such fine separations.

Since aflatoxin-affected peanuts are lighter and less dense than non-affected peanuts, it has been suggested to separate such affected peanuts using a water flotation technique. While this technique has allowed more sophisticated separation than conventional techniques, water flotation techniques yield water-logged peanuts which must subsequently be dried. This added drying step, of course, adds an extra cost to the peanuts and results in lower quality peanuts.

It has also been suggested to split the peanuts in half, thereby exposing the aflatoxin fungus itself. The aflatoxin affected peanuts could then be separated using conventional sensor equipment. While this technique allows for a very sophisticated separation, it adds an extra cutting step which increases the manufacturing cost. Also, it is unsatisfactory where whole peanuts are desired. Further, many commercial applications require peanuts which have not been split. For these applications, the splitting technique is not commercially viable.

Fluidized beds have been used previously for specific gravity separation. Forsberg (U.S. Pat. No. 2,928,545) discloses a gravity separator for separating grain from light particles, such as chaff, and heavy particles, such as stones. A mixture of grain and foreign particles is fed onto an oscillating deck, and air is fed through the deck to cause the materials to separate according to density. Extremely high density materials, such as stones, fall to the perforated screen and are conveyed upwardly to be discharged at the upper end portion of the deck. The lighter materials are conveyed toward the lower end of the deck, where a skimmer removes the light, undesirable materials.

Gravity separators have also been used for separating foreign material from peanuts. Examples of such gravity separators include Carter et al. (U.S. Pat. No. 2,429,343), Hobbs (U.S. Pat. No. 3,400,84), Paul (U.S. Pat. No. 2,449,007), Solomon, Jr. et al. (U.S. Pat. No. 162,392). While these separators have satisfactorily separated stones and other heavy material from peanuts and have separated very light material from peanuts, these techniques are not satisfactory for separating material which differs only slightly from the weight of the desired peanuts. Thus, they cannot be employed to separate aflatoxin affected peanuts from desirable product.

SUMMARY OF THE INVENTION

Accordingly, it is an object of the present invention to provide a method and apparatus for separating aflatoxin-affected peanuts from the unaffected peanuts.

A further object to the invention is to provide a method and apparatus for separating undesired products from peanuts, wherein the undesired products differ in weight from the desired peanuts by as little as 10 percent.

Yet another object of the present invention is to provide a method and apparatus for separating peanuts without requiring additional steps in the manufacturing process.

Still another object of the present invention is to provide an apparatus and process for mass producing quantities of whole, unaffected peanuts.

The foregoing and additional objects are attained by a modified fluidized bed or specific gravity separation technique which can achieve separation of material differing in weight by as little as 1 percent. A separating apparatus has a finely perforated screen (1/16 roundhole) with a fluidized bed thereon. Peanuts are delivered to a center portion of the fluidized bed where an initial separation takes place. The heaviest peanuts sink to the bottom of the bed and are transported to the discharge end by the perforated screen. The lighter peanuts are transported toward the opposite end of the separating apparatus where a second separation occurs. A compressed air jet and weir assembly is located in ⅓ of this end, so that lighter peanuts which travel toward the end are stopped by the weir. The air jet controllably lifts only the lightest of the floating peanuts over the weir and out of the separation apparatus leaving the desired peanut products remaining in the apparatus. By using the combination of the weir, the fine perforated deck, and the controllable air jet, it is possible to achieve a very fine separation of peanuts.

Further objects and advantages of the present invention will become apparent to those skilled in the art from the drawings and description, which follow.

DETAILED DESCRIPTION OF THE PREFERRED EMBODIMENTS

Figure 1:
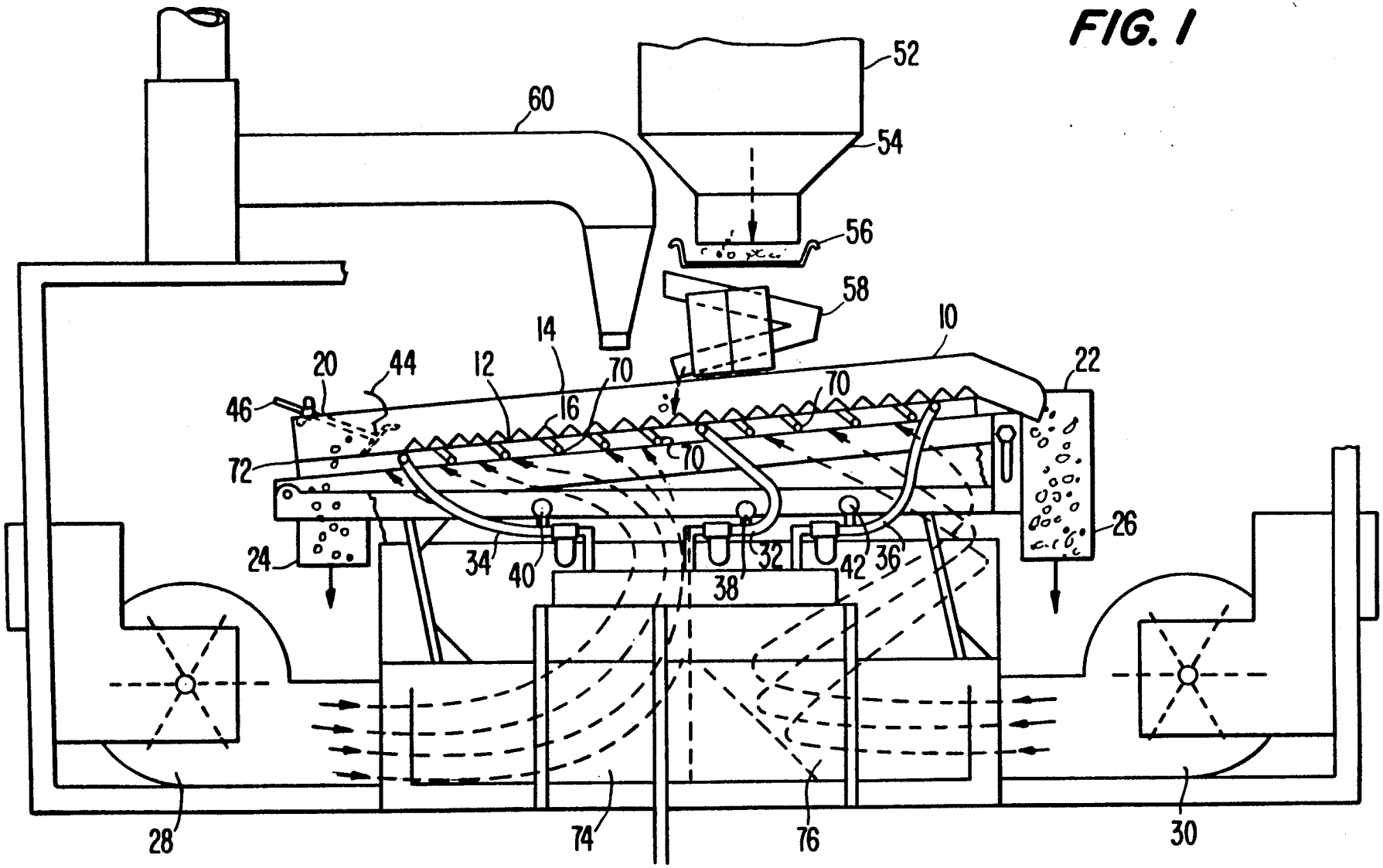
FIG. 1 is a schematic side view of a separation apparatus according to the invention.
Figure 2:
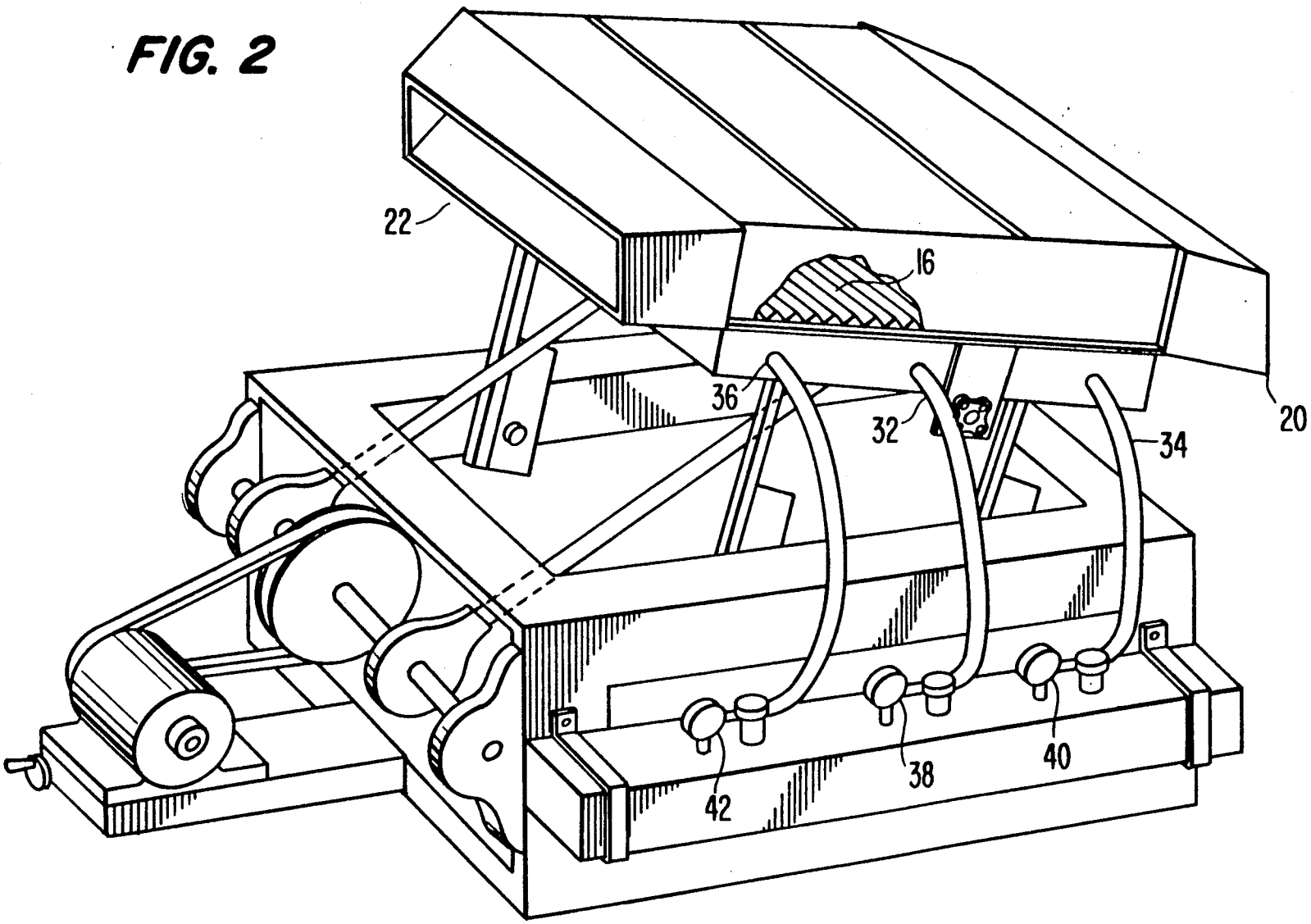
FIG. 2 is a top perspective view of a separation apparatus according to the invention.
Figure 3:
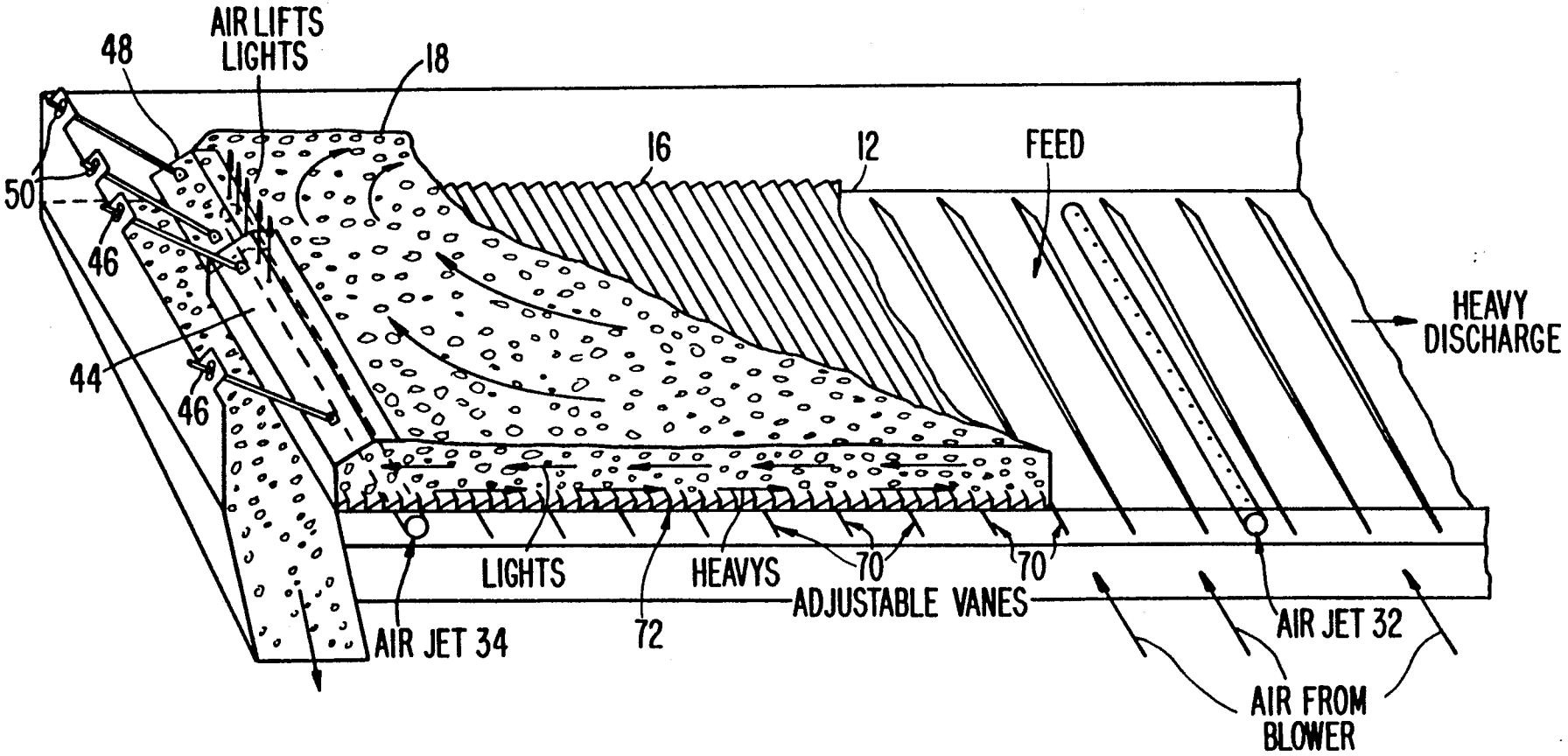
FIG. 3 is a top view of a fluidized bed separation according to the invention.

The present invention, as shown in FIG. 1, comprehends a separation apparatus which is shown here in schematic cross section. This separation apparatus comprises an inclined shoe 10 which includes a perforated screen 12 and side rails 14. The perforated screen 12 has a plurality of riffles 16 thereon, or some equivalent means, for transporting peanuts 18 along the inclined shoe 10. An oscillator (not shown) of a type known in the art is used to aid in the transportation of the peanuts along the inclined shoe 10.

The inclined shoe 10 has a first reject peanut discharge end 20 and a second discharge end 22 wherein the desired peanuts are discharged. Containers 24 and 26 are located at the first and second discharge ends, respectively, for receiving the peanuts.

Two or more fans, such as fans, e.g. 28 and 30, are in fluid communication with the underside of the perforated screen 12. Adjustable vanes 70 under the deck 72, which includes screen 12 and riffles 16, direct the air toward the exit weir 48. Fans 28 and 30 should be of sufficient power to create a fluidized bed on the perforated screen 12. The speed of fan 28 and 30 are carefully controlled so that the two chambers 74, 76 may have different air pressure under the deck 72. A plurality of compressed air jets are also located beneath the perforated screen 12. The first compression jet 32 is located near the point on the perforated screen where the peanuts are loaded into the sorting apparatus. Second compression jet 34 is located adjacent to the reject peanut discharge end 20 of the sorting apparatus. A third compression jet 36 is located adjacent the second discharge end 22 of the sorting apparatus. Pressure regulators 38, 40, 42 are provided with compression jets 32, 34, 36, respectively, to control the pressure of the respective jets.

A raised barrier 44 is located adjacent to the reject peanuts discharge end 20 next to the reject peanut container 24. The height and inclination of the raised barrier 44 may be varied by use of one or more adjusting bolts 46. The raised barrier 44 is mounted transversely of the inclined shoe 10 and extends across most of the width thereof. An exit weir 48 at an exit portion extends along the remainder (approximately ⅓) of the reject end 20 of the inclined shoe 10. The height of the exit weir 48 is adjustable and may be less than the height of the raised barrier 44. The purpose for this will be described in greater detail below. The exit weir 48 is also provided with one or more adjusting bolts 50 to vary the height and inclination thereof.

A feed assembly located above a central portion of the inclined shoe 10 delivers pre-sized peanuts to the sorting apparatus. The feed assembly 52 comprises a feed hopper 54, a vibrating feeder 56 and an easy down system 58. A skin-removing air assembly 60 is located adjacent the feed assembly. The skin-removing air assembly creates a suction, whereby loose skins from the peanuts are sucked through the assembly before the peanuts reach the inclined shoe 10.

In operation, peanuts 18 from the feed hopper 54 are fed down the easy down system 58. As these peanuts fall onto the inclined shoe 10, they are met by a gust of air from the first compression jet 32. This gust of air assures that aflatoxin affected peanuts are not trapped under heavier peanuts and are instead transported with the desired peanuts. The peanuts which are delivered to the inclined shoe float on the fluidized bed created by the fans 28 and 30.

The heaviest peanuts sink immediately to the floor of the perforated screen 12 and are transported by the oscillator toward the second discharge end 22 on riffles 16. The lightest peanuts float on the fluidized bed toward the reject peanut discharge end 20. Since the shoe is inclined, gravity causes the lighter peanuts to move toward the reject peanut discharge end 20. It has been found that an incline of 5 percent produces especially advantageous results. The inclined shoe 10 may also be tilted sideways toward the exit weir 48.

As the peanuts travel down the inclined shoe 10, they abut the raised barrier 44. When the inclined shoe 10 is tilted toward the exit weir 48, the peanuts travel transversely along the raised barrier 44 toward exit weir 48. Compression jet 34 delivers compressed air at a predetermined pressure, e.g., 3 to 5 PSI, to the portion of the inclined shoe 10 adjacent the exit weir 48. This causes only the lightest of the peanuts to be lifted gently over the exit weir 48 into container 24. The compression jet 34 can be adjusted by using the pressure gauge 40, to control the separation of the peanuts. Thus, the separation precision of the apparatus can be controlled as desired. If any lighter peanuts are missed they will be lifted again by the middle air jet and float to the exit weir, thus assuring that substantially all aflatoxin affected peanuts are removed.

It will be understood that the present invention is not limited to the preferred embodiments shown and described. The invention can also be used to remove foreign material, immature peanuts, insect damaged peanuts, and unshelled peanuts from desired peanuts.

What is claimed is:

1. An apparatus for sorting peanuts, comprising:

a finely perforated screen having a first end and a second end, the screen being inclined so that the first end is lower than the second end;

means for delivering peanuts to the screen;

means for forming a fluidized bed upon the screen, so that lighter peanuts float on the fluidized bed while heavier peanuts fall toward an upper surface of the screen;

means, located at said first end, for selectively separating lighter weight peanuts from the fluidized bed, the selective separating means comprising a raised barrier extending across all but an exit portion of the first end;

an exit weir at the exit portion; and a first compressed air means for delivering continuous air pressure at the exit portion, the air pressure being directed at an angle to the exit weir whereby lighter ones of the peanuts are selectively removed from the fluidized bed as the air pressure delivered to the exit end lifts the lighter ones of the peanuts over the exit weir.

2. The apparatus according to claim 1, wherein the raised barrier extends vertically higher above the screen than the exit weir.

3. The apparatus of claim 1, wherein the screen has perforations and the means for forming the fluidized bed comprises fans in communication with an underside of the screen.

4. The apparatus recited in claim 3 wherein the fans produce different air pressure in chambers under the screen.

5. The apparatus recited in claim 4, further comprising vanes directing a portion of the air from the fans toward the exit weir.

6. The apparatus recited in claim 4, further comprising a plurality of riffles on the screen, the screen being oscillated to cause heavier peanuts to move toward the second end.

7. The apparatus recited in claim 1, wherein said first compressed air means is adjustable and comprises at least one compression jet and pressure regulator, whereby adjustment of said first compressed air means precisely controls separation of lighter peanuts.

8. The apparatus recited in claim 1 wherein said means for delivering peanuts is located to delivery said peanuts to a delivery location remote from either end of said screen and further comprising a second compressed air means for delivering air pressure from beneath said delivery location, thereby preventing trapping of lighter weight peanuts under heavier peanuts.

9. A method of sorting peanuts, the method comprising the steps of:

delivering peanuts to an inclined screen having a first end lower than a second end;

forming a fluidized bed upon the screen, so that lighter weight peanuts floating on the fluidized bed are drawn by gravity down toward a barrier at the first end while heavier peanuts move along the screen surface toward the second end of the screen;

further separating the lighter weight peanuts at an exit portion of the first end, the separating step comprising delivering continuous pressurized air at an angle to the exit portion, thereby lifting lighter peanuts over an exit weir.

10. The method recited in claim 9, wherein the heavier peanuts are directed toward the second end by oscillating the screen.

11. The method recited in claim 9, wherein the screen is formed with perforations and the step of forming the fluidized bed comprises:

directing air flow in two separate air chambers to an underside of the screen to produce different air pressures at first and second portions of the screen.

12. The method recited in claim 9, wherein the barrier at the first end is extended across all of the first end and is used in controlling depth of the fluidized bed in conjunction with a speed of a fan communicating with an underside of the screen and a speed of an oscillating deck moving the screen.

13. The method recited in claim 12, wherein an adjustable portion of the exit weir can be vertically and horizontally extended to remove peanuts of various specific gravity over the exit weir.

14. The method recited in claim 9, wherein the screen is tilted in a transverse direction toward the exit weir.

* * * * *